US007762053B2

(12) United States Patent
Takada

(10) Patent No.: US 7,762,053 B2
(45) Date of Patent: Jul. 27, 2010

(54) COMPOSITE YARN AND CUT-RESISTANT GLOVE USING THE YARN

(75) Inventor: Teruyoshi Takada, Hyogo (JP)

(73) Assignee: Showa Glove Co., Himeji-shi (JP)

( * ) Notice: Subject to any disclaimer, the term of this patent is extended or adjusted under 35 U.S.C. 154(b) by 517 days.

(21) Appl. No.: 11/630,156

(22) PCT Filed: May 25, 2006

(86) PCT No.: PCT/JP2006/310948

§ 371 (c)(1),
(2), (4) Date: Dec. 20, 2006

(87) PCT Pub. No.: WO2007/015333

PCT Pub. Date: Feb. 8, 2007

(65) Prior Publication Data

US 2008/0289312 A1 Nov. 27, 2008

(30) Foreign Application Priority Data

Aug. 1, 2005 (JP) ..... 2005-222926

(51) Int. Cl.
*D02G 3/02* (2006.01)
*D02G 3/36* (2006.01)

(52) U.S. Cl. ..... 57/230

(58) Field of Classification Search ..... 57/210, 57/227, 230

See application file for complete search history.

(56) References Cited

U.S. PATENT DOCUMENTS

| | | | | | |
|---|---|---|---|---|---|
| 4,384,449 | A | | 5/1983 | Byrnes, Sr. et al. | 57/210 |
| 4,470,251 | A | | 9/1984 | Bettcher | 57/230 |
| 4,777,789 | A | * | 10/1988 | Kolmes et al. | 57/210 |
| 4,838,017 | A | * | 6/1989 | Kolmes et al. | 57/210 |
| 5,423,168 | A | * | 6/1995 | Kolmes et al. | 57/229 |
| 5,965,223 | A | * | 10/1999 | Andrews et al. | 428/34.5 |
| 6,016,648 | A | * | 1/2000 | Bettcher et al. | 57/230 |

(Continued)

FOREIGN PATENT DOCUMENTS

JP 53-46840 4/1978

(Continued)

OTHER PUBLICATIONS

International Search Report dated Sep. 6, 2006.

*Primary Examiner*—Shaun R Hurley
(74) *Attorney, Agent, or Firm*—Kratz, Quintos & Hanson, LLP

(57) ABSTRACT

A composite yarn is provided which comprises a core and a covering layer formed by wrapping a covering fiber around the core, the core being composed of a metal thin wire and an attending yarn comprising a filament yarn, wherein the attending yarn is wound around the metal thin wire at 5 to 60 turns per meter of the metal thin wire. A cut-resistant glove formed of the composite yarn is also provided. The composite yarn of the present invention is preferably usable for protective products such as protective fabrics, protective clothes, protective aprons and protective gloves used for protecting workers and a cut-resistant glove formed of the composite fiber is excellent not only in moisture absorption property, but also in putting-on-feeling, use feeling and workability in the state of being put on.

12 Claims, 2 Drawing Sheets

U.S. PATENT DOCUMENTS

| | | | | |
|---|---|---|---|---|
| 6,279,305 | B1 * | 8/2001 | Hummel | 57/210 |
| 6,363,703 | B1 * | 4/2002 | Kolmes | 57/210 |
| 6,467,251 | B1 * | 10/2002 | Kolmes | 57/230 |
| 6,779,330 | B1 * | 8/2004 | Andrews et al. | 57/210 |
| 6,826,898 | B1 * | 12/2004 | Hummel | 57/210 |
| 6,880,320 | B2 * | 4/2005 | Olinger et al. | 57/228 |
| 2003/0074879 | A1 * | 4/2003 | Patrick | 57/229 |
| 2005/0086924 | A1 * | 4/2005 | Kolmes | 57/229 |
| 2007/0062173 | A1 * | 3/2007 | Hummel | 57/210 |

FOREIGN PATENT DOCUMENTS

| | | |
|---|---|---|
| JP | 59-178379 | 11/1984 |
| JP | 62-153326 | 9/1987 |
| JP | 62-157915 | 10/1987 |
| JP | 63-196727 | 8/1988 |
| JP | 1-74285 | 5/1989 |
| JP | 01-183544 | 7/1989 |
| JP | 01-239104 | 9/1989 |
| JP | 2005-060892 | 3/2005 |
| JP | 2005-105458 | 4/2005 |

* cited by examiner

COMPOSITE YARN AND CUT-RESISTANT GLOVE USING THE YARN

TECHNICAL FIELD

The present invention relates to a composite yarn and a cut-resistant glove using the composite yarn and, more particularly, to a composite yarn to be used for protective products such as protective fabrics, protective clothes, protective aprons for cutting workers in edible meat processing works where sharp blades are used, glass producing or processing works or metal processing works where glass and metal plates with sharp edges are handled and a cut-resistant glove using the composite yarn.

BACKGROUND ART

As such types of yarns, use of metal yarn (wire) alone for armors or the like has formerly been popular especially in Europe. In recent years, to make such yarn lightweight and to improve the workability and strength, various kinds of composite yarns comprising metal yarn in combination with cotton yarn and high strength filaments have been proposed.

For example, a core-sheath composite yarn produced by winding a synthetic fiber and thus covering a core comprising a high strength yarn and a wire with the synthetic fiber is proposed, and as an example, a glove obtained by knitting a core-sheath composite yarn produced by wrapping a nylon fiber in upper and lower double layers around a core comprising a 3,4'-diaminodiphenyl ether copolymer-polyparaphenylene terephthalamide fiber and a stainless wire is disclosed in Japanese Patent Application Laid-Open No. 1-239104.

Also, a composite spun yarn having a core-sheath structure produced by covering a core part of a single wire of a metal yarn, a filament yarn, or a spun yarn with a staple of an aromatic polyamide fiber is proposed in Japanese Patent Application Laid-Open No. 63-303138.

Also, a cut-resistant glove formed of a composite yarn comprising a fiber having a high strength and a high modulus of elasticity, and a metal thin wire in the surface and a bulky yarn or a natural fiber in the back face is proposed in Japanese Patent Application Laid-Open No. 2000-178812.

Further, a cut-resistant composite yarn comprising a glass fiber as a core part and a polyethylene fiber or aramid fiber as a sheath part, and further a covering fiber of a non-metallic and non-high performance fiber such as a polyester, nylon, or the like wrapped in mutually opposite directions is proposed in U.S. Pat. No. 6,467,251.

Further, a cut-resistant fiber produced by wrapping a polyester fibers in opposite directions around a core part composed of a stainless steel wire and an anti-microbial treated acetate type fiber and an apparel such as a glove produced from the fiber are proposed in U.S. Pat. No. 6,266,951.

Furthermore, a cut-resistant composite yarn comprising a core part composed of a strand of wire and an extended chain polyethylene fiber being positioned parallel to each other, wrapped around the core with double layer-covering strands in mutually opposite directions, in which an aramid fiber is not used, is disclosed in U.S. Pat. No. 5,644,907.

However, although having cut resistance, the above-mentioned conventional composite yarns are inferior in moisture absorption properties and also inferior in knitting processability, for example, since the stainless wire and the glass fiber are sometimes ruptured in the case of producing gloves by knitting the composite yarns and gloves produced by knitting the composite yarns give an uncomfortable putting-on-feeling or use feeling, and particularly, the ruptured stainless wire and glass fiber irritate the skin, and therefore, the workability in the case when the gloves are put on is not satisfactory. Especially, there is a serious problem that the stainless wire and glass fiber used as cores are exposed to the outside of the composite yarns and irritate hands and fingers by pricking them.

In light of the foregoing situation, the present invention provides a composite yarn having an excellent knitting processability as well as a good moisture adsorption properties, and further provides a cut-resistant glove formed of the composite yarn, which is excellent not only in elastic properties and moisture absorption properties, but also in wearing or use feeling and workability at the time the glove is put on.

DISCLOSURE OF THE INVENTION

Inventors of the present invention have made an intensive series of investigations for solving the above-mentioned problems and have found that a composite yarn comprising a core composed of a metal thin wire and an attending yarn of a filament yarn wound around the metal thin wire at a specified number of turns, and a covering layer formed by wrapping a covering fiber around the core could attain the above-mentioned objects.

Further, the inventors of the present invention have found that in the case of knitting the above-mentioned composite yarn to produce a glove, plating is carried out by using a specified fiber and the plated fiber is knitted to be set in the inner side of the glove, so that the glove could further improved in elastic properties, moisture absorption properties, and the use feeling and workability at the time the glove is put on.

The present invention has been accomplished based on the above-mentioned findings.

The present invention for attaining the above-mentioned object encompasses, in the first aspect, a composite yarn comprising a core and a covering layer formed by wrapping a covering fiber around the core, the core being composed of a metal thin wire and an attending yarn comprising a filament yarn, wherein the attending yarn is wound around the metal thin wire at 5 to 60 turns per meter of the metal thin wire.

The present invention encompasses, in the second aspect, the composite yarn according to the first aspect, wherein the metal thin wire comprises a stainless steel.

The present invention encompasses, in the third aspect, the composite yarn according to aspect one or two, wherein the attending yarn comprises at least one filament yarn selected from polyethylene, polyester and polyparaphenylene terephthalamide.

The present invention encompasses, in the fourth aspect, the composite yarn according to the third aspect, wherein the polyethylene comprises ultra high molecular weight polyethylene.

The present invention encompasses, in the fifth aspect, the composite yarn according to the third aspect, wherein the attending yarn comprises polyester.

The present invention encompasses, in the sixth aspect, the composite yarn according to any one of the first to fifth aspect, wherein the covering fiber comprises at least one fiber selected from polyethylene, polyaramid, polyester, polyamide, polyacryl, cotton and wool.

The present invention encompasses, in the seventh aspect, the composite yarn according to the sixth aspect, wherein the covering fiber comprising polyester or polyamide is crimped.

The present invention encompasses, in the eighth aspect, the composite yarn according to any one of the first to seventh aspect, wherein the covering layer comprises a first covering layer and a second covering layer wrapped in the opposite direction to that of the first covering layer.

The present invention encompasses, in the ninth aspect, a cut-resistant glove produced by knitting the composite yarn according to any one of the first to eighth aspect.

The present invention encompasses, in the tenth aspect, the cut-resistant glove according to the ninth aspect, wherein the glove is plated with a synthetic fiber or a natural fiber in such a manner that the plated fiber is set in the inside of the glove.

The present invention encompasses, in the eleventh aspect, the cut-resistant glove according to the tenth aspect, wherein the synthetic fiber for plating comprises a composite fiber of a polyurethane fiber and at least one synthetic fiber selected from polyamide, polyethylene, polyester, polyphenylene terephthalamide and rayon, or at least one synthetic fiber selected from polyamide, polyethylene, polyester, polyphenylene terephthalamide and rayon.

The present invention encompasses, in the twelfth aspect, the cut-resistant glove according to the tenth aspect, wherein the natural fiber for plating comprises cotton.

Figure 1:
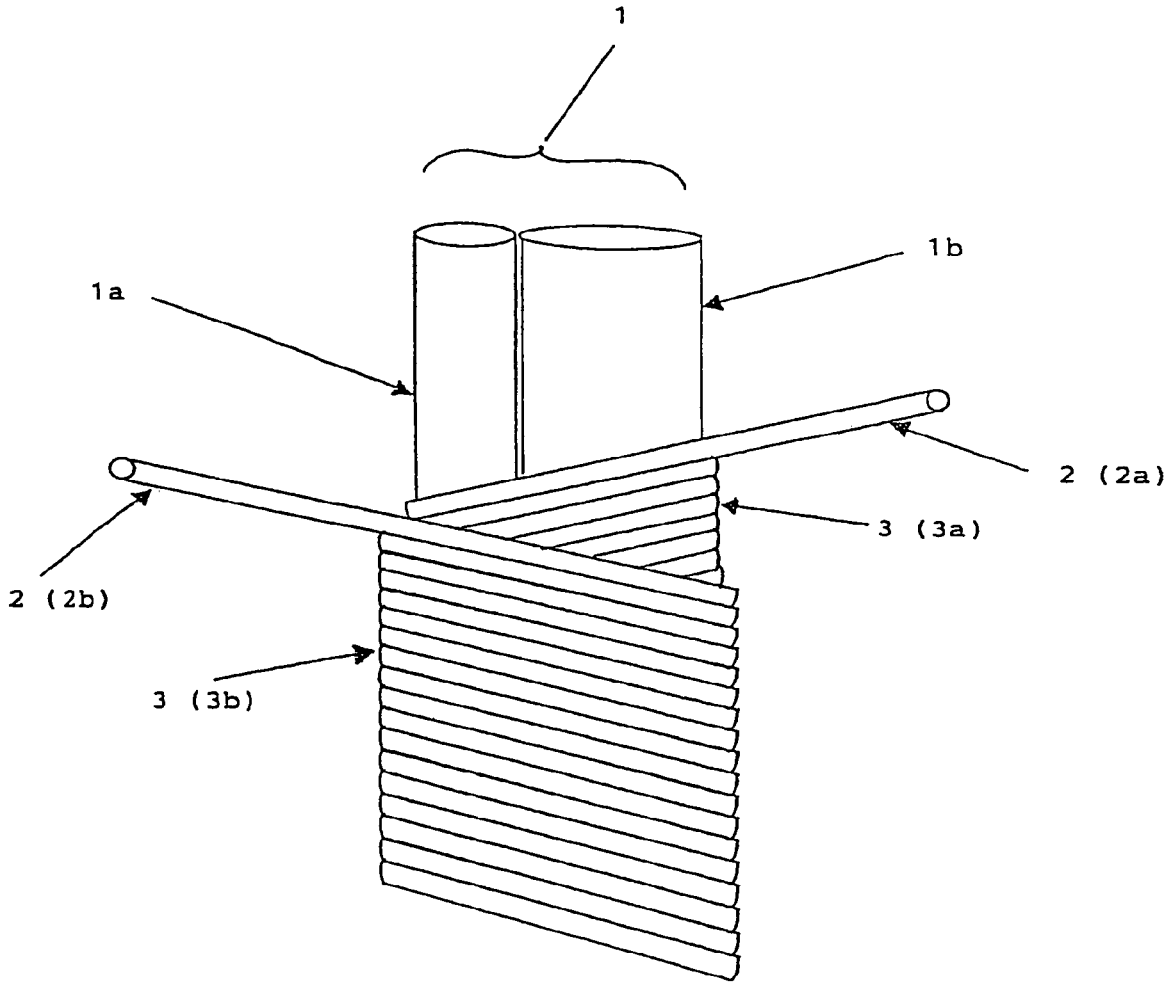
FIG. 1 is a schematic drawing showing one example of the composite yarn of the present invention.

In the drawing, the numerals stand for the followings:

1 core,

1*a* metal thin wire,

1*b* attending yarn,

2 covering fiber,

2*a* covering fiber of a first layer,

2*b* covering fiber of a second layer,

3 covering layer,

3*a* covering layer of a first layer,

3*b* covering layer of a second layer.

Figure 2:
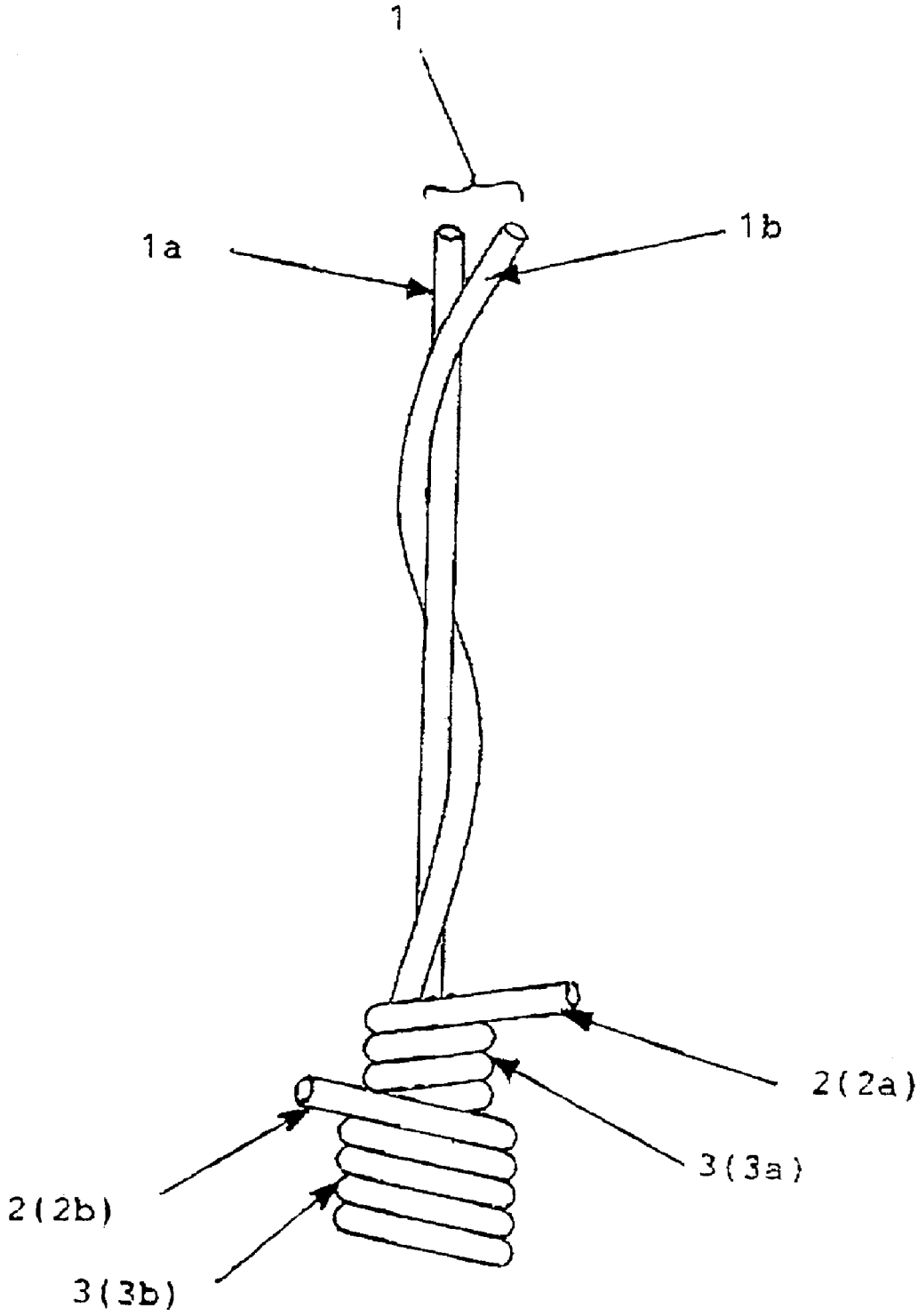

FIG. 2 is a schematic drawing showing an attending yarn being wound around a metal wire.

BEST MODE FOR CARRYING OUT THE INVENTION

The present invention comprises, as shown by FIG. 1, a core 1 and a covering layer 3 formed by wrapping a covering fiber 2 around the core 1.

The above-mentioned core 1 comprises a metal thin wire 1*a* and an attending yarn 1*b*, which is a filament yarn.

The metal thin wire 1*a* used in the present invention is preferably a stainless, titanium, aluminum, silver, nickel, copper, bronze or the like with a high strength and a high modulus of elasticity, and particularly, a stainless is preferable since it is economical and has a high strength as well as it is excellent in chemical stability and corrosion resistance.

Meanwhile, "stainless" is correctly "stainless steel", however, domestically it is generally abbreviated as "stainless" or "stain" and therefore, in this specification, the term "stainless" is used for its abbreviation.

As the metal thin wire 1*a*, a non-processed wire is used in the present invention since a twisted wire is hard and results in a feeling of a product formed of a composite yarn, for example, a glove (hereinafter, a glove is taken as a representative product formed of a composite yarn.).

For example, as a thin wire of a stainless, those with 40 to 50 μm thickness are commonly used for such purposes. The metal thin wire 1*a* in the present invention has a thickness of preferably 10 to 70 μm, more preferably 15 to 35 μm in terms of the knitting processability of the composite yarn and workability in the state of wearing the glove. As a practical material for the stainless, SUS 304 is preferable in terms of softness and bending strength.

As the metal thin wire 1*a*, 1 to 4 pieces is preferred to be used. In the case of more than 4 pieces, a glove becomes hard and results in poor workability in the state of wearing on the glove, and therefore that is not preferable.

The metal thin wire 1*a* of the core is ruptured when it is wrapped with the covering fiber 2 as it is in a covering step and therefore, the attending yarn 1*b* is needed for the metal thin wire 1*a*. As the attending yarn 1*b*, a non-processed filament yarn is used since a processed yarn such as a twist yarn has rather considerable elastic property. If a yarn having the elastic property is used as the attending yarn 1*b*, the yarn to be used for covering in the successive covering step is also provided with the elastic property. Meanwhile, the metal thin wire 1*a* itself scarcely has the elastic property and if the composite yarn is expanded after the covering with the covering fiber 2 is formed, the metal thin wire 1*a* cannot stand in the elongation and thus is ruptured. The ruptured metal thin wire 1*a* springs out of the covering layer 3 of the composite yarn 2 and, for example, when the composite yarn is knitted into a glove product, the metal thin wire 1*a* pricks the skin of a hand of the user of the glove and thus worsens the putting-on-feeling and use feeling. On the other hand, even if the attending yarn 1*b* contrarily has the contractive property, the same phenomenon occurs. That is, in the case where the attending yarn 1*b* contracts, the metal thin wire 1*a* cannot contract and therefore it sags and since the sagging cannot be released, the metal thin wire 1*a* springs out of the covering layer 3 of the composite yarn 2 and irritates the skin of a hand of the user of the glove and gives an unpleasant feeling.

Accordingly, the attending yarn 1*b* used in the present invention is preferably a filament fiber scarcely having not only the dynamic elasticity, but also the elasticity affected by heat and chemicals. Practically, examples of such filament fiber are polyethylene, ultra high molecular weight polyethylene, which are reinforced polyethylene (e.g. trade name: Dyneema, manufactured by Toyobo Co., Ltd.), polyester, polyparaphenylene terephthalamide (e.g. trade name: Kevlar, manufactured by Du Pont de Nemours & Co.), and the like. Among these, ultra high molecular polyethylene, polyparaphenylene terephthalamide and polyester are preferable since they are very stable physically and chemically. These may be used singly or, if necessary, in a combination of two or more.

The fineness of these attending yarns 1*b* may be selected properly according to the uses of the composite yarn, and in general, it is preferably 50 to 600 denier, more preferably 100 to 450 denier. If it is thinner than 50 denier, the rupture prevention effect of the metal thin wire 1*a* tends to be weakened. In the case where an attending yarn with a thickness exceeding 600 denier is used, the composite yarn obtained becomes thick and tends to give a stiff feeling, which results in poor putting-on-feeling and use feeling. The number of the filaments forming the attending yarn 1*b* is preferably higher since the attending yarn 1*b* winds the metal thin wire to prevent exposure of the surface of the metal thin wire 1*a* and it is, in general, preferably not less than 100 filaments, more preferably 100 to 1000 filaments, and still more preferably 200 to 1000 filaments. If it is less than 100 filaments, the effect of winding the metal thin wire 1*a* becomes insufficient, the knitting processability is decreased and the putting-on-feeling and use feeling tend to be worsened. On the other hand, if it is more than 1000 filaments, the cost of the attending yarn tends to increase, which makes it not practical to use.

The attending yarn 1*b* is wound around the metal thin wire 1*a* at 5 to 60 turns, preferably 15 to 50 turns, more preferably 25 to 45 turns per meter of the metal thin wire. This winding prevents the metal thin wire not only from cutting when tension is imposed, but also from exposing its surface when flexure or distortion takes place. In the case of less than 5 turns, the above-mentioned effects are not provided satisfactorily, for example, when knitted into a glove, the metal thin wire 1*a* ruptures, springs out and irritates the skin of a hand of a wearer to thus reduce touch feeling, putting-on-feeling and use feeling. On the other hand, in the case of more than 60 turns, when tension is imposed, the wound attending yarn is easy to elongate as compared with the metal thin wire being positioned straight and thus tension cannot be dispersed to the attending yarn so that the metal thin wire tends to be ruptured.

As the attending yarn 1*b*, 1 to 3 pieces is preferred. In the case of more than 3 pieces, the attending yarn tends to become thick, which not only reduces knitting processability, but also tends to worsen putting-on-feeling to be a stiff feeling.

As described above, the covering layer 3 is formed by wrapping the covering fiber 2 around the core 1 composed of the metal thin wire 1*a* and the attending yarn 1*b*.

The covering fiber 2 is not particularly limited and is determined in consideration of the knitting processability, resin coating processability, the putting-on-feeling, use feeling such as touch feeling, the moisture absorption property, and the like. From a viewpoint of these properties, the covering fiber 2 of, polyethylene, polyaramide, polyester, polyamide (nylon), polyacryl, cotton, wool and the like are preferable. The covering fiber 2 may be multifilaments, twist yarn or spun yarn. Among these, polyester, polyamide (nylon), cotton and wool are more preferable. As the spun yarn, cotton or polyester is preferable in terms of softness. As the filament of the covering fiber 2, it is preferable to be crimped, particularly, crimped polyester or polyamide is preferable in terms of a good touch feeling.

The fineness of the covering fiber 2 may properly be determined depending on the uses of the composite yarn to be obtained and it is, in general, preferably 50 to 500 denier (100 to 10 yarn counts) and more preferably 50 to 300 denier (100 to 15 yarn counts) in terms of the prevention of the surface exposure of the metal thin wire 1*a* and the putting-on-feeling and use feeling of knitted products. In the case of the covering fiber comprising filaments, the number of the filaments is preferably 20 to 500 filaments. In the case of less than 20 filaments, the thickness of the filament becomes large to result in a stiff feeling, on the other hand, in the case of more than 500 filaments, the cost becomes high and thus that is not preferable.

The covering fiber 2 is wrapped around the core 1. The number of the layers of wrapping the coating fiber 2 may properly be selected depending on the uses of the composite yarn to be obtained, however, if the number of the layers is small, the effect of covering the core 1 becomes so insufficient as to expose the core to the outside of the covering layer 3 in some cases, and on the other hand, if the number is large, the knitting processability of the composite yarn tends to be deteriorated and it results in a stiff feeling and deteriorates the putting-on-feeling and use feeling. Accordingly, it is preferable to be two layers. In the case where the covering fiber 2 is wrapped in two layers, as shown in FIG. 1, the covering fiber 2 itself is wrapped in opposite directions. That is, the covering fiber 2*a* in the first layer is wrapped clockwise and the covering fiber 2*b* in the second layer is wrapped counterclockwise to form the first covering layer 3*a* and the second covering layer 3*b*, respectively. In FIG. 1, winding of the attending yarn 1*b* around the metal thin wire 1*a* is omitted.

The number of wrapping turns of the covering fiber 2 may properly be determined depending on the uses of the composite yarn to be obtained, it is preferably 300 to 1200 turns, more preferably 450 to 1000 turns, per one meter of the length of the core 1. In the case of less than 300 turns, the purpose of preventing the surface exposure of the metal thin wire 1*a* is not attained adequately, on the other hand, in the case of more than 1000 turns, the obtained composite yarn becomes hard, which is not preferable.

As the covering fiber 2, 1 to 6 pieces per one layer is suitable. In the case of more than 6 pieces, a step for producing a composite yarn tends to become complicated and the obtained composite yarn tends to give stiff a feeling.

The composite yarn obtained in the above manner is used for producing various kinds of protective products such as protective fabrics, protective clothes, protective aprons and protective gloves for protecting workers by a common knitting machine and the composite yarn of the present invention is particularly suitable for a cut-resistant glove.

At the time of producing the cut-resistant glove by knitting the composite yarn of the present invention, plating is carried out using a fiber having a good touch feeling and excellent moisture absorption property and knitting is carried out to set the plated fiber in the inner side of the glove, so that the cut-resistant glove excellent in the putting-on-feeling or use feeling such as touch feeling and in the moisture absorption properties can be produced.

As such a plating fiber, synthetic fibers such as composite fibers of a polyurethane fiber and at least one synthetic fiber selected from polyamide, polyethylene, polyester, polyphenylene terephthalamide and rayon, synthetic fibers such as polyamide, polyethylene, polyester, polyphenylene terephthalamide, rayon and the like, and natural fibers such as cotton are preferable.

The fiber for the plating may properly be determined depending on the use and a plurality of kinds of fibers may be used. The thickness of the plating fiber is preferably 50 to 700 denier, more preferably 50 to 550 denier, for one fiber in terms of the putting-on-feeling and the workability. If it is thinner than 50 denier, the effect of plating tends to be insufficient. If it exceeds 700 denier, the knitted density of the plating fiber becomes high and the knitting workability tends to deteriorate. The number of the fibers to be used for plating may properly be determined and it is preferably 1 to 7 fibers, more preferably 1 to 5 fibers in terms of the easy plating processability.

Hereinafter, the present invention will be described in more detail with reference to Examples and Comparative Examples, however, the present invention is in no way limited thereto or thereby.

In the following Examples and Comparative Examples, D stands for a denier, F stands for a number of filaments.

The property evaluations of respective sample gloves obtained in the following Examples and Comparative Examples were carried out by the following method and the results are shown in Table 1.

(Cut Resistance)

The hand portions of the respective gloves were evaluated using a CUT-TESTER, "COUPETEST", manufactured by Sodemat. A cotton fabric as a standard fabric was cut before and after the samples and the number of rotations of a round blade (45 mmϕ) until the round blade touched a metal plate set under the respective samples and was stopped and measured and the measurement data was calculated according to the following equation (1). Measurements for each sample were carried out continuously five times and the level was calculated based on the average value of the five times.

$$(N+n)/n \quad (1)$$

wherein, N denotes the times of cutting the sample, and n denotes the average of the cutting times of the standard fabric.

(Level)

Not less than 1.2 and less than 2.5: level 1,
Not less than 2.5 and less than 5.0: level 2,
Not less than 5.0 and less than 10.0: level 3,
Not less than 10.0 and less than 20.0: level 4, and
Not less than 20.0: level 5.

(Workability, Touch Feeling, and Moisture Absorption Property)

Judgment was done by five panelists based on the following standards and the averages were employed as the evaluation results.

A: very good, B: good, C: normal, D: bad, E: very bad.

EXAMPLE 1

One stainless thin wire with a thickness of 25 μm (SUS 304 stainless steel wire, manufactured by Nippon Seisen Co., Ltd.) and one ultra high molecular weight polyethylene filament yarn with 400D/390F (trade name: Dyneema SK 60, manufactured by Toyobo Co., Ltd.) were united together by gently winding the ultra high molecular weight polyethylene filament yarn around the stainless thin wire at 33 turns/m and used as a core, and one wooly-processed nylon fiber with 70D/24F (a nylon yarn, manufactured by Hantex Co.) was wrapped at 634 turns/m around the core and further one wooly-processed nylon fiber with 70D/24F (a nylon yarn, manufactured by Hantex Co.) was wrapped at 634 turns/m thereon in the opposite direction to form a covering layer and a composite yarn was obtained.

Next, using the obtained composite yarn, a glove was knitted by a 10G knitting machine to obtain a sample glove.

The obtained sample glove had the cut resistance in the 5 CE level and was found to have a contact of a wooly nylon with the skin of a hand and gave a very good touch feeling when it was put on a hand, an excellent elastic property, and further a very good workability.

EXAMPLE 2

One stainless thin wire with a thickness of 25 μm (SUS 304 stainless steel wire, manufactured by Nippon Seisen Co., Ltd.) and one ultra high molecular weight polyethylene filament yarn with 400D/390F (trade name: Dyneema SK60, manufactured by Toyobo Co., Ltd.) were united together by gently winding the ultra high molecular weight polyethylene filament yarn around the stainless thin wire at 10 turns/m and used as a core, and one wooly-processed nylon fiber with 70D/24F (a nylon yarn, manufactured by Hantex Co.) was wrapped at 634 turns/m around the core and further one wooly-processed nylon fiber with 70D/24F (a nylon yarn, manufactured by Hantex Co.) was wrapped at 634 turns/m thereon in the opposite direction to form a covering layer and a composite yarn was obtained.

Next, using the obtained composite yarn, a glove was knitted by a 10G knitting machine to obtain a sample glove.

The obtained sample glove had the cut resistance in the 5 CE level and was found to have a contact of a wooly nylon with the skin of a hand and gave a very good touch feeling when it was put on the hand, an excellent elastic property, and further a very good workability.

EXAMPLE 3

One stainless thin wire with a thickness of 25 μm (SUS 304 stainless steel wire, manufactured by Nippon Seisen Co., Ltd.) and one ultra high molecular weight polyethylene filament yarn with 400D/390F (trade name: Dyneema SK60, manufactured by Toyobo Co., Ltd.) were united together by gently winding the ultra high molecular weight polyethylene filament yarn around the stainless thin wire at 55 turns/m and used as a core, and one wooly-processed nylon fiber with 70D/24F (a nylon yarn, manufactured by Hantex Co.) was wrapped at 634 turns/m around the core, and further one wooly-processed nylon fiber with 70D/24F (a nylon yarn, manufactured by Hantex Co.) was wrapped at 634 turns/m thereon in the opposite direction to form a covering layer and a composite yarn was obtained.

Next, using the obtained composite yarn, a glove was knitted by a 10G knitting machine to obtain a sample glove.

The obtained sample glove had the cut resistance in the 5 CE level and was found to have a contact of a wooly nylon on the inside with the skin of a hand and gave a very good touch feeling when it was put on the hand, an excellent elastic property, and further a very good workability.

COMPARATIVE EXAMPLE 1

One stainless thin wire with a thickness of 25 μm (SUS 304 stainless steel wire, manufactured by Nippon Seisen Co., Ltd.) and one ultra high molecular weight polyethylene filament yarn with 400D/390F (trade name: Dyneema SK60, manufactured by Toyobo Co., Ltd.) were united together by gently winding the ultra high molecular weight polyethylene filament yarn around the stainless thin wire at 2 turns/m and used as a core, and one wooly-processed nylon fiber with 70D/24F (a nylon yarn, manufactured by Hantex Co.) was wrapped at 634 turns/m around the core, and further one wooly-processed nylon fiber with 70D/24F (a nylon yarn, manufactured by Hantex Co.) was wrapped at 634 turns/m thereon in the opposite direction to form a covering layer and a composite yarn was obtained.

Next, using the obtained composite yarn, a glove was knitted by a 10G knitting machine to obtain a sample glove.

The obtained sample glove had the cut resistance in the 5 CE level, but was found giving a bad touch feeling when it was put on the hand since the stainless thin wire sprung out of spaces among the attending yarns and the covering fibers, and broke, which irritated the skin of a hand.

COMPARATIVE EXAMPLE 2

One stainless thin wire with a thickness of 25 μm (SUS 304 stainless steel wire, manufactured by Nippon Seisen Co., Ltd.) and one ultra high molecular weight polyethylene filament yarn with 400D/390F (trade name: Dyneema SK60, manufactured by Toyobo Co., Ltd.) were united together by gently winding the ultra high molecular weight polyethylene filament yarn around the stainless thin wire at 70 turns/m and used as a core and one wooly-processed nylon fiber with 70D/24F (a nylon yarn, manufactured by Hantex Co.) was wrapped at 634 turns/m around the core, and further one wooly-processed nylon fiber with 70D/24F (a nylon yarn, manufactured by Hantex Co.) was wrapped at 634 turns/m thereon in the opposite direction to form a covering layer and a composite yarn was obtained.

Next, using the obtained composite yarn, a glove was knitted by a 10G knitting machine to obtain a sample glove.

The obtained sample glove had the cut resistance in the 5 CE level, but was found to give a bad touch feeling when it was put on the hand since the stainless thin wire which did not stand the tension imposed at the step of preparing the composite yarn or the step of knitting the glove, broke and sprung out of spaces among the attending yarns and the covering fibers, which irritated the skin of a hand.

EXAMPLE 4

One stainless thin wire with a thickness of 25 μm (SUS 304 stainless steel wire, manufactured by Nippon Seisen Co., Ltd.) and one ultra high molecular weight polyethylene filament yarn with 400D/390F (trade name: Dyneema SK 60, manufactured by Toyobo Co., Ltd.) were united together by gently winding the ultra high molecular weight polyethylene filament yarn around the stainless thin wire at 33 turns/m and used as a core and one wooly-processed nylon fiber with 70D/24F (a nylon yarn, manufactured by Hantex Co.) was wrapped at 634 turns/m around the core, and further one wooly-processed nylon fiber with 70D/24F (a nylon yarn, manufactured by Hantex Co.) was wrapped at 634 turns/m thereon in the opposite direction to form a covering layer and a composite yarn was obtained.

Next, using the obtained composite yarn, and using one FTY (false twist yarn) composed of one polyurethane fiber with 40D (trade name: Spandex, manufactured by FURNI-WEB Co.) and two wooly-processed nylon fibers with 70D/24F, which was obtained by twisting two wooly-processed nylon fibers around one polyurethane fiber (hereinafter, the same applies.) in the knitting process, a glove was knitted by a 10G knitting machine in such a manner that the composite yarn was set on the outside of the glove and the FTY on the inside of the glove and a sample glove was obtained.

The obtained sample glove had the cut resistance in the 5 CE level and was found to have a contact of the wooly nylon on the inside with the skin of a hand and giving very good touch feeling when it was put on a hand, an excellent elastic property, and further a very good workability.

EXAMPLE 5

One stainless thin wire with a thickness of 25 μm (SUS 304 stainless steel wire, manufactured by Nippon Seisen Co., Ltd.) and one ultra high molecular weight polyethylene filament yarn with 400D/390F (trade name: Dyneema SK60, manufactured by Toyobo Co., Ltd.) were united together by gently winding the ultra high molecular weight polyethylene filament yarn around the stainless thin wire at 10 turns/m and used as a core and one wooly-processed nylon fiber with 70D/24F (a nylon yarn, manufactured by Hantex Co.) was wrapped at 634 turns/m around the core, and further one wooly-processed nylon fiber with 70D/24F (a nylon yarn, manufactured by Hantex Co.) was wrapped at 634 turns/m thereon in the opposite direction to form a covering layer and a composite yarn was obtained.

Next, using the obtained composite yarn, and using one FTY (false twist yarn) composed of one polyurethane fiber with 40D (trade name: Spandex, manufactured by FURNI-WEB Co.) and two wooly-processed nylon fibers with 70D/24F in the knitting process, a glove was knitted by a 10G knitting machine in such a manner that the composite yarn was set on the outside of the glove and the FTY on the inside of the glove and a sample glove was obtained.

The obtained sample glove had the cut resistance in the 5 CE level and was found to have a contact of the wooly nylon on the inside with the skin of a hand and gave a very good touch feeling when it was put on the hand, an excellent elastic property and moisture absorption property, and further a very good workability.

EXAMPLE 6

One stainless thin wire with a thickness of 25 μm (SUS 304 stainless steel wire, manufactured by Nippon Seisen Co., Ltd.) and one ultra high molecular weight polyethylene filament yarn with 400D/390F (trade name: Dyneema SK60, manufactured by Toyobo Co., Ltd.) were united together by gently winding the ultra high molecular weight polyethylene filament yarn around the stainless thin wire at 55 turns/m and used as a core and one wooly-processed nylon fiber with 70D/24F (a nylon yarn, manufactured by Hantex Co.) was wrapped at 634 turns/m around the core, and further one wooly-processed nylon fiber with 70D/24F (a nylon yarn, manufactured by Hantex Co.) was wrapped at 634 turns/m thereon in the opposite direction to form a covering layer and a composite yarn was obtained.

Next, using the obtained composite yarn, and using one FTY (false twist yarn) composed of one polyurethane fiber with 40D (trade name: Spandex, manufactured by FURNI-WEB Co.) and two wooly-processed nylon fibers with 70D/24F in the knitting process, a glove was knitted by a 10G knitting machine in such a manner that the composite yarn was set on the outside of the glove and the FTY on the inside of the glove and a sample glove was obtained.

The obtained sample glove had the cut resistance in the 5 CE level and was found to have a contact of the wooly nylon in the inside with the skin of a hand and gave a very good touch feeling when it was put on the hand, an excellent elastic property and moisture absorption property, and further a very good workability.

COMPARATIVE EXAMPLE 3

One stainless thin wire with a thickness of 25 μm (SUS 304 stainless steel wire, manufactured by Nippon Seisen Co., Ltd.) and one ultra high molecular weight polyethylene filament yarn with 400D/390F (trade name: Dyneema SK60, manufactured by Toyobo Co., Ltd.) were united together by gently winding the ultra high molecular weight polyethylene filament yarn around the stainless thin wire at 2 turns/m and used as a core and one wooly-processed nylon fiber with 70D/24F (a nylon yarn, manufactured by Hantex Co.) was wrapped at 634 turns/m around the core, and further one wooly-processed nylon fiber with 70D/24F (a nylon yarn, manufactured by Hantex Co.) was wrapped at 634 turns/m thereon in the opposite direction to form a covering layer and a composite yarn was obtained.

Next, using the obtained composite yarn, and using one FTY (false twist yarn) composed of one polyurethane fiber with 40D (trade name: Spandex, manufactured by FURNI-WEB Co.) and two wooly-processed nylon fibers with 70D/24F in the knitting process, a glove was knitted by a 10G knitting machine in such a manner that the composite yarn was set in the outside of the glove and the FTY in the inside of the glove and a sample glove was obtained.

The obtained sample glove had the cut resistance in the 5 CE level, but was found to give a bad touch feeling when it was put on the hand since the stainless thin wire sprung out of spaces among the attending yarns and the covering fibers and broke, which irritated the skin of a hand.

COMPARATIVE EXAMPLE 4

One stainless thin wire with a thickness of 25 μm (SUS 304 stainless steel wire, manufactured by Nippon Seisen Co., Ltd.) and one ultra high molecular weight polyethylene filament yarn with 400D/390F (trade name: Dyneema SK60, manufactured by Toyobo Co., Ltd.) were united together by gently winding the ultra high molecular weight polyethylene filament yarn around the stainless thin wire at 70 turns/m and used as a core and one wooly-processed nylon fiber with 70D/24F (a nylon yarn, manufactured by Hantex Co.) was wrapped at 634 turns/m around the core, and further one wooly-processed nylon fiber with 70D/24F (a nylon yarn, manufactured by Hantex Co.) was wrapped at 634 turns/m thereon in the opposite direction to form a covering layer and a composite yarn was obtained.

Next, using the obtained composite yarn, and using one FTY (false twist yarn) composed of one polyurethane fiber with 40D (trade name: Spandex, manufactured by FURNI-WEB Co.) and two wooly-processed nylon fibers with 70D/24F in the knitting process, a glove was knitted by a 10G knitting machine in such a manner that the composite yarn was set on the outside of the glove and the FTY on the inside of the glove and a sample glove was obtained.

The obtained sample glove had the cut resistance in the 5 CE level, but was found to give a bad touch feeling when it was put on the hand since the stainless thin wire which did not stand the tension imposed at the step of preparing the composite yarn or the step of knitting the glove broke and sprung out of spaces among the attending yarns and the covering fibers, which irritated the skin of a hand.

EXAMPLE 7

One stainless thin wire with a thickness of 25 μm (SUS 304 stainless steel wire, manufactured by Nippon Seisen Co., Ltd.) and one ultra high molecular weight polyethylene filament yarn with 400D/390F (trade name: Dyneema SK 60, manufactured by Toyobo Co., Ltd.) were united together by gently winding the ultra high molecular weight polyethylene filament yarn around the stainless thin wire at 33 turns/m and used as a core and one wooly-processed nylon fiber with 70D/24F (a nylon yarn, manufactured by Hantex Co.) was wrapped at 634 turns/m around the core, and further two polyester textured fibers with 75D/36F (manufactured by LEALEA ENTERISE CO. LTD.) were wrapped at 634 turns/m thereon in the opposite direction to form a covering layer and a composite yarn was obtained.

Next, using the obtained composite yarn, and using one FTY (false twist yarn) composed of one polyurethane fiber with 40D (trade name: Spandex, manufactured by FURNI-WEB Co.) and two wooly-processed nylon fibers with 70D/24F in the knitting process, a glove was knitted by a 13G knitting machine in such a manner that the composite yarn was set on the outside of the glove and the FTY on the inside of the glove and a sample glove was obtained.

The obtained sample glove had the cut resistance in the 5 CE level and was found to have a contact of the wooly nylon on the inside with the skin of a hand, having a thin thickness, and giving a very good touch feeling when it was put on a hand, an excellent elastic property, and further a very good workability.

EXAMPLE 8

One stainless thin wire with a thickness of 25 μm (SUS 304 stainless steel wire, manufactured by Nippon Seisen Co., Ltd.) and one ultra high molecular weight polyethylene filament yarn with 400D/390F (trade name: Dyneema SK 60, manufactured by Toyobo Co., Ltd.) were united together by gently winding the ultra high molecular weight polyethylene filament yarn around the stainless thin wire at 33 turns/m and used as a core and one wooly-processed nylon fiber with 70D/24F (a nylon yarn, manufactured by Hantex Co.) was wrapped at 634 turns/m around the core, and further one polyester textured fiber with 75D/36F (manufactured by LEALEA ENTERISE CO. LTD.) was wrapped at 634 turns/m thereon in the opposite direction to form a covering layer and a composite yarn was obtained.

Next, using the obtained composite yarn, and using one FTY (false twist yarn) composed of one polyurethane fiber with 40D (trade name: Spandex, manufactured by FURNI-WEB Co.) and two wooly-processed nylon fibers with 70D/24F in the knitting process, a glove was knitted by a 13G knitting machine in such a manner that the composite yarn was set on the outside of the glove and the FTY on the inside of the glove and a sample glove was obtained.

The obtained sample glove had the cut resistance in the 5 CE level and was found to have a contact of the wooly nylon on the inside with the skin of a hand, having a thin thickness, and giving a very good touch feeling when it was put on a hand, an excellent elastic property, and further a very good workability.

EXAMPLE 9

One stainless thin wire with a thickness of 25 μm (SUS 304 stainless steel wire, manufactured by Nippon Seisen Co., Ltd.) and one polyaraphenylene terephthalamide filament yarn with 400D/252F (trade name: Kevlar, manufactured by Du Pont de Nemours & Co.) were united together by gently winding the polyparaphenylene terephthalamide filament yarn around the stainless thin wire at 33 turns/m and used as a core and one polyester short fiber No. 20 (trade name, Polyester Span, manufactured by MWE Co.) was wrapped at 840 turns/m around the core and further one polyester short fiber No. 20 (trade name, Polyester Span, manufactured by MWE Co.) was wrapped at 840 turns/m thereon in the opposite direction to form a covering layer and a composite yarn was obtained.

Next, using the obtained composite yarn, and using two polyester short fibers No. 20 (trade name: Polyester Span, manufactured by MWE Co.) in the knitting process, a glove was knitted by a 10G knitting machine in such a manner that the composite yarn was set on the outside of the glove and the polyester short fibers on the inside of the glove and a sample glove was obtained.

The obtained sample glove had the cut resistance in the 5 CE level and was found to have a good and strong feeling when it was put on a hand, an excellent sweat absorption property, and further a very good workability.

EXAMPLE 10

One stainless thin wire with a thickness of 25 μm (SUS 304 stainless steel wire, manufactured by Nippon Seisen Co., Ltd.) and one polyaraphenylene terephthalamide filament yarn with 400D/252F (trade name: Kevlar, manufactured by Du Pont de Nemours & Co.) were united together by gently winding the polyparaphenylene terephthalamide filament yarn around the stainless thin wire at 33 turns/m and used as a core and one polyester short fiber No. 20 (trade name, Polyester Span, manufactured by MWE Co.) was wrapped at 840 turns/m around the core and further one polyester short fiber No. 20 (trade name, Polyester Span, manufactured by MWE Co.) was wrapped at 840 turns/m thereon in the opposite direction to form a covering layer and a composite yarn was obtained.

Next, using the obtained composite yarn, and using three polyester short fibers No. 20 (trade name: Polyester Span, manufactured by MWE Co.) in the knitting process, a glove was knitted by a 10G knitting machine in such a manner that the composite yarn was set on the outside of the glove and the polyester short fibers on the inside of the glove and a sample glove was obtained.

The obtained sample glove had the cut resistance in the 5 CE level and was found to have a good and strong feeling when it was put on a hand, an excellent sweat absorption property, and further a very good workability.

EXAMPLE 11

One stainless thin wire with a thickness of 25 μM (SUS 304 stainless steel wire, manufactured by Nippon Seisen Co., Ltd.) and one polyaraphenylene terephthalamide filament yarn with 400D/252F (trade name: Kevlar, manufactured by Du Pont de Nemours & Co.) were united together by gently winding the polyparaphenylene terephthalamide filament yarn around the stainless thin wire at 33 turns/m and used as a core and one cotton fiber No. 20 (trade name, Cotton Span, manufactured by MWE Co.) was wrapped at 840 turns/m around the core and further one cotton fiber No. 20 (trade name, Cotton Span, manufactured by MWE Co.) was wrapped at 840 turns/m thereon in the opposite direction to form a covering layer and a composite yarn was obtained.

Next, using the obtained composite yarn, and using two cotton fibers No. 20 (trade name: Polyester Span, manufactured by MWE Co.) in the knitting process, a glove was knitted by a 10G knitting machine in such a manner that the composite yarn was set on the outside of the glove and the cotton fibers on the inside of the glove and a sample glove was obtained.

The obtained sample glove had the cut resistance in the 5 CE level and was found to have a good feeling when it was put on a hand, an excellent sweat absorption property, and further a very good workability.

EXAMPLE 12

One stainless thin wire with a thickness of 25 μm (SUS 304 stainless steel wire, manufactured by Nippon Seisen Co., Ltd.) and one polyaraphenylene terephthalamide filament yarn with 400D/252F (trade name: Kevlar, manufactured by Du Pont de Nemours & Co.) were united together by gently winding the polyparaphenylene terephthalamide filament yarn around the stainless thin wire at 33 turns/m and used as a core and one cotton fiber No. 20 (trade name, Cotton Span, manufactured by MWE Co.) was wrapped at 840 turns/m around the core and further one cotton fiber No. 20 (trade name, Cotton Span, manufactured by MWE Co.) was wrapped at 840 turns/m thereon in the opposite direction to form a covering layer and a composite yarn was obtained.

Next, using the obtained composite yarn, and using three cotton fibers No. 20 (trade name: Polyester Span, manufactured by MWE Co.) in the knitting process, a glove was knitted by a 10G knitting machine in such a manner that the composite yarn was set on the outside of the glove and the cotton fibers on the inside of the glove and a sample glove was obtained.

The obtained sample glove had the cut resistance in the 5 CE level and was found to have a good feeling when it was put on a hand, an excellent sweat absorption property, and further a very good workability.

EXAMPLE 13

One stainless thin wire with a thickness of 25 μm (SUS 304 stainless steel wire, manufactured by Nippon Seisen Co., Ltd.) and one polyaraphenylene terephthalamide filament yarn with 400D/252F (trade name: Kevlar, manufactured by Du Pont de Nemours & Co.) were united together by gently winding the polyparaphenylene terephthalamide filament yarn around the stainless thin wire at 33 turns/m and used as a core and one wooly-processed nylon fiber with 70D/24F (a nylon yarn, manufactured by Hantex Co.) was wrapped at 840 turns/m around the core and further one wooly-processed nylon fiber with 70D/24F (a nylon yarn, manufactured by Hantex Co.) was wrapped at 840 turns/m thereon in the opposite direction to form a covering layer and a composite yarn was obtained.

Next, using the obtained composite yarn, and using one FTY (false twist yarn) composed of one polyurethane fiber with 40D (trade name: Spandex, manufactured by FURNI-WEB Co.) and two wooly-processed nylon fibers with 70D/24F in the knitting process, a glove was knitted by a 13G knitting machine in such a manner that the composite yarn was set on the outside of the glove and the FTY on the inside of the glove and a sample glove was obtained.

The obtained sample glove had the cut resistance in the 5 CE level and was found to have a smooth surface and to have a contact of the wooly nylon in the inside with the skin of a hand, giving a very good touch feeling when it was put on a hand, an excellent elastic property, a thin thickness, and further a very good workability.

EXAMPLE 14

One stainless thin wire with a thickness of 25 μm (SUS 304 stainless steel wire, manufactured by Nippon Seisen Co., Ltd.) and one ultra high molecular weight polyethylene filament yarn with 400D/390F (trade name: Dyneema SK 60, manufactured by Toyobo Co., Ltd.) were united together by gently winding the ultra high molecular weight polyethylene filament yarn around the stainless thin wire at 33 turns/m and used as a core and one wooly-processed nylon fiber with 70D/24F (a nylon yarn, manufactured by Hantex Co.) was wrapped at 840 turns/m around the core and further one polyester short fiber No. 20 (trade name: Polyester Span, manufactured by MWE Co.) was wrapped at 840 turns/m thereon in the opposite direction to form a covering layer and a composite yarn was obtained.

Next, using the obtained composite yarn, and using one FTY (false twist yarn) composed of one polyurethane fiber with 140D (trade name: Spandex, manufactured by FURNI-WEB Co.) and two ultra high molecular weight polyesthylene fibers with 400D/390F (trade name: Dyneema SK60, manufactured by Toyobo Co., Ltd.) in the knitting process, a glove was knitted by a 13G knitting machine in such a manner that the composite yarn was set on the outside of the glove and the FTY on the inside of the glove and a sample glove was obtained.

The obtained sample glove had the cut resistance in the 5 CE level and was found to have a smooth surface and to have a contact of the FTY in the inside with the skin of a hand, giving very good touch feeling when it was put on a hand, an excellent elastic property, a thin thickness, and further a very good workability.

EXAMPLE 15

One stainless thin wire with a thickness of 25 μM (SUS 304 stainless steel wire, manufactured by Nippon Seisen Co., Ltd.) and one polyester filaMent yarn with 140D/432F (trade name: EC155-432-ISGZ71BT, manufactured by Toyobo Co., Ltd.) were united together by gently winding the polyester filament yarn around the stainless thin wire at 33 turns/m and used as a core and one cotton fiber No. 30 (manufactured by Colony Textile Mills Ltd.) was wrapped at 840 turns/m around the core and further one polyester short fiber No. 32 (trade mane, manufactured by PT Ramagloria Sakti Tekstil Industri) was wrapped at 840 turns/m thereon in the opposite direction to form a covering layer and a composite yarn was obtained.

Next, using the obtained composite yarn, and using one cotton fiber No. 20 (trade name: Cotton Span, manufactured by MWE Co.) in the knitting process, a glove was knitted by a 10G knitting machine in such a manner that the composite yarn was set on the outside of the glove and the cotton fiber on the inside of the glove and a sample glove was obtained.

The obtained sample glove had the cut resistance in the 5 CE level and was found to have a contact of the cotton fiber in the inside with the skin of a hand, giving very good touch feeling when it was put on a hand, an excellent sweat absorption property, and further a very good workability.

COMPARATIVE EXAMPLE 5

In accordance with Example 1 described in Japanese Patent Application Laid-Open No. 1-239104, three spun yarns (yarn No. 10.63) (equivalent to 1500 denier) obtained by stretch-breaking a non-crimped tow of 2000 filaments with 3000 denier of polyparaphenylene terephthalamide fiber (trade name: Technorat, manufactured by Teijin Kasei Ltd.) at 750 mm intervals and 20 times stretch-breaking ratio between a pair of rollers and two flexible stainless wires (25 μm) were united together and used as a core and a nylon fiber of 420 denier was wrapped at 634 turns/m around the core in the upper and lower double layers, respectively in the opposite direction to obtain a composite yarn. Two composite yarns obtained were united together and knitted by a 5G knitting machine to obtain a sample glove.

The obtained sample glove had the cut resistance in the 5 CE level, but, since the plating yarn was the spun yarn, the plating yarn was expanded at the time of processing and the metal thin wire was ruptured and the tip end of the metal thin wire came out of the composite yarn, and thus the glove gave a prickly irritating touch and had an inferior workability at the time of being put on.

As described above, the composite yarn of the present invention forms a core comprising a metal thin wire and an attending yarn which is wound around the metal thin wire at the specified turns, and forms a covering layer by wrapping a covering fiber around the circumference of the core, so that the composite yarn is excellent, not only in the moisture absorption property, but also in the knitting processability. The composite yarn of the present invention is preferably usable for protective products such as protective fabrics, protective clothes, protective aprons and protective gloves used for protecting workers and is particularly preferably used for providing a cut-resistant glove having excellent putting-on-feeling and use feeling, and having good workability in the state of being put on.

In the case of knitting the above-mentioned composite yarn to produce a glove, if a fiber is plated and the plated fiber is knitted to set it in the inside of the glove, the glove obtained is further improved not only in the elastic property and the moisture absorption property, but also in the putting-on-feeling or use feeling and workability at the time the glove is put on.

TABLE 1

| | Core | | | | Covering fiber | | | |
|---|---|---|---|---|---|---|---|---|
| | | Attending yarn | | | 1st layer | | | |
| | Metal thin wire | Kind | D/F | Turns (T/m) | Kind | D/F | Turns (T/m | 2nd layer Kind |
| Ex. 1 | Stainless 1 (25 μm) | PE filament 1 (Dyneema) | 400/390 | 33 | Nylon 1 | 70/24 | 634 | Nylon 1 |
| Ex. 2 | Stainless 1 (25 μm) | PE filament 1 (Dyneena) | 400/390 | 10 | Nylon 1 | 70/24 | 634 | Nylon 1 |
| Ex. 3 | Stainless 1 (25 μm) | PE filament 1 (Dyneema) | 400/390 | 55 | Nylon 1 | 70/24 | 634 | Nylon 1 |
| Comp. Ex. 1 | Stainless 1 (25 μm) | PE filament 1 (Dyneema) | 400/390 | 2 | Nylon 1 | 70/24 | 634 | Nylon 1 |
| Comp. Ex. 2 | Stainless 1 (25 μm) | PE filament 1 (Dyneema) | 400/390 | 70 | Nylon 1 | 70/24 | 634 | Nylon 1 |
| Ex. 4 | Stainless 1 (25 μm) | PE filament 1 (Dyneema) | 400/390 | 33 | Nylon 1 | 70/24 | 634 | Nylon 1 |
| Ex. 5 | Stainless 1 (25 μm) | PE filament 1 (Dyneema) | 400/390 | 10 | Nylon 1 | 70/24 | 634 | Nylon 1 |
| Ex. 6 | Stainless 1 (25 μm) | PE filament 1 (Dyneema) | 400/390 | 55 | Nylon 1 | 70/24 | 634 | Nylon 1 |
| Comp. Ex. 3 | Stainless 1 (25 μm) | PE filament 1 (Dyneema) | 400/390 | 2 | Nylon 1 | 70/24 | 634 | Nylon 1 |
| Comp. Ex. 4 | Stainless 1 (25 μm) | PE filament 1 (Dyneema) | 400/390 | 70 | Nylon 1 | 70/24 | 634 | Nylon 1 |
| Ex. 7 | Stainless 1 | PE filament 1 (Dyneema) | 400/390 | 33 | Nylon 1 | 70/24 | 634 | PET textured 2 |
| Ex. 8 | Stainless 1 (25 μm) | PE filament 1 (Dyneema) | 400/390 | 33 | Nylon 1 | 70/24 | 634 | PET textured 1 |
| Ex. 9 | Stainless 1 | PPTA filament 1 (Kevlar) | 400/252 | 33 | PET span 1 | No. 20 | 840 | PET span 1 |

TABLE 1-continued

| | | | | | | | | |
|---|---|---|---|---|---|---|---|---|
| Ex. 10 | Stainless 1 | PPTA filament 1 (Kevlar) | 400/252 | 33 | PET span 1 | No. 20 | 840 | PET span 1 |
| Ex. 11 | Stainless 1 | PPTA filament 1 (Kevlar) | 400/252 | 33 | Cotton 1 | No. 20 | 840 | Cotton 1 |
| Ex. 12 | Stainless 1 | PPTA filament 1 (Kevlar) | 400/252 | 33 | Cotton 1 | No. 20 | 840 | Cotton 1 |
| Ex. 13 | Stainless 1 | PPTA filament 1 (Kevlar) | 400/252 | 33 | Nylon 1 | 70/24 | 840 | Nylon 1 |
| Ex. 14 | Stainless 1 | PE filament 1 (Dyneema) | 400/390 | 33 | Nylon 1 | 70/24 | 840 | PET span 1 |
| Ex. 15 | Stainless 1 (26 μm) | PET filament 1 | 140/432 | 33 | Cotton 1 | No. 30 | 840 | PET span 1 |
| Comp. Ex. 5 | Stainless 2 | Technorat Spun yarn | — | — | Nylon | 420 D | 634 | Nylon |

| | Covering fiber 2nd layer | | | Knitting | Cut | | | Moisture |
|---|---|---|---|---|---|---|---|---|
| | D/F | Turns (T/m | Plating | machine (G) | resistance (CE) | Workability (Softness) | Touch feeling | absorption property |
| Ex. 1 | 70/24 | 634 | — | 10 | 5 | A | B | C |
| Ex. 2 | 70/24 | 634 | — | 10 | 5 | A | C | C |
| Ex. 3 | 70/24 | 634 | — | 10 | 5 | A | B | C |
| Comp. Ex. 1 | 70/24 | 634 | — | 10 | 5 | A | E | C |
| Comp. Ex. 2 | 70/24 | 634 | — | 10 | 5 | A | D | C |
| Ex. 4 | 70/24 | 634 | FTY Spandex 1 Nylon 2 | 10 | 5 | A | A | B |
| Ex. 5 | 70/24 | 634 | FTY Spandex 1 Nylon 2 | 10 | 5 | A | B | B |
| Ex. 6 | 70/24 | 634 | FTY Spandex 1 Nylon 2 | 10 | 5 | A | A | B |
| Comp. Ex. 3 | 70/24 | 634 | FTY Spandex 1 Nylon 2 | 10 | 5 | A | D | B |
| Comp. Ex. 4 | 70/24 | 634 | FTY Spandex 1 Nylon 2 | 10 | 5 | A | D | B |
| Ex. 7 | 75/36 | 634 | FTY Spandex 1 Nylon 2 | 13 | 5 | A | A | B |
| Ex. 8 | 75/36 | 634 | FTY Spandex 1 Nylon 2 | 13 | 5 | A | A | B |
| Ex. 9 | No. 20 | 840 | Polyester span 2 | 10 | 5 | A | B | A |
| Ex. 10 | No. 20 | 840 | Polyester span 3 | 10 | 5 | A | B | A |
| Ex. 11 | No. 20 | 840 | Cotton 2 | 10 | 5 | A | A | A |
| Ex. 12 | No. 20 | 840 | Cotton 3 | 10 | 5 | A | A | A |
| Ex. 13 | 70/24 | 634 | FTY Spandex 1 Nylon 2 | 13 | 5 | A | A | B |
| Ex. 14 | No. 20 | 840 | FTY Spandex 1 Dyneema 2 | 13 | 5 | A | A | B |
| Ex. 15 | No. 32 | 840 | Cotton 1 | 13 | 5 | A | B | B |
| Comp. Ex. 5 | 420 D | 634 | — | 5 | 5 | C | D | C |

INDUSTRIAL APPLICABILITY

As described above, the composite yarn of the present invention forms a core comprising a metal thin wire and an attending yarn which is wound around the metal thin wire at the specified turns, and forms a covering layer by wrapping a covering fiber around the circumference of the core, so that the composite yarn is excellent in the elastic property, the moisture absorption property, and the knitting processability. The composite yarn of the present invention is preferably usable for protective products such as protective fabrics, protective clothes, protective aprons and protective gloves used for protecting workers and is particularly preferably used for providing a cut-resistant glove excellent in putting-on-feeling, use feeling and workability in the state of being put on.

Moreover, in the case of knitting the above-mentioned composite yarn to produce a glove, if a fiber is plated, and the plated fiber is knitted to set it on the inside of the glove, the glove obtained is further improved, not only in the elastic property and the moisture absorption property, but also in the putting-on-feeling or use feeling and workability at the time the glove is put on.

What is claimed is:

1. A composite yarn comprising a core and a covering layer formed by wrapping a covering fiber around the core, the core being composed of a metal thin wire and an attending yarn comprising a filament yarn, wherein the attending yarn is wound around the metal thin wire at 5 to 60 turns per meter of the metal thin wire with the metal thin wire being in a non-twisted state, and the attending yarn comprises at least one filament yarn with the properties of having substantially no elasticity, being heat resistant and being chemical resistant.

2. A composite yarn comprising a core and a covering layer formed by wrapping a covering fiber around the core, the core being composed of a metal thin wire and an attending yarn comprising a filament yarn, wherein the attending yarn is wound around the metal thin wire at 5 to 60 turns per meter of the metal thin wire with the metal thin wire being in a non-twisted state, and the attending yarn comprises at least one filament yarn selected from the group consisting of polyethylene, ultra high molecular weight polyethylene, polyester and polyparaphenylene terephthalamide.

3. The composite yarn according to claim 2, wherein the attending yarn comprises ultra high molecular weight polyethylene.

4. The composite yarn according to claim 2, wherein the attending yarn comprises polyester.

5. The composite yarn according to claim 1 or 2, wherein the metal thin wire comprises a stainless steel.

6. The composite yarn according to claim 1 or 2, wherein the covering fiber comprises at least one fiber selected from the group consisting of polyethylene, polyaramid, polyester, polyamide, polyacryl, cotton and wool.

7. The composite yarn according to claim 6, wherein the covering fiber comprising polyester or polyamide is crimped.

8. The composite yarn according to claim 1 or 2, wherein the covering layer comprises a first covering layer and a second covering layer wrapped in the opposite direction to that of the first covering layer.

9. A cut-resistant glove produced by knitting the composite yarn according to claim 1 or 2.

10. The cut-resistant glove according to claim 9, wherein the glove is plated with a synthetic fiber or a natural fiber, separate from the covering layer, in such a manner that the plated fiber is set in the inside of the glove.

11. The cut-resistant glove according to claim 10, wherein the synthetic fiber for plating comprises a composite fiber of a polyurethane fiber and at least one synthetic fiber selected from the group consisting of polyamide, polyethylene, polyester, polyphenylene terephthalamide and rayon, or at least one synthetic fiber selected from the group consisting of polyamide, polyethylene, polyester, polyphenylene terephthalamide and rayon.

12. The cut-resistant glove according to claim 10, wherein the natural fiber for plating comprises cotton.

* * * * *